US006264321B1

(12) United States Patent
Bugner et al.

(10) Patent No.: US 6,264,321 B1
(45) Date of Patent: Jul. 24, 2001

(54) METHOD OF PRODUCING RECORDED IMAGES HAVING ENHANCED DURABILITY ON A VARIETY OF SUBSTRATES

(75) Inventors: Douglas Eugene Bugner, Rochester; Alfred John Amell, Spencerport; Douglas Edward Garman, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/907,825

(22) Filed: Aug. 14, 1997

Related U.S. Application Data

(63) Continuation-in-part of application No. 08/542,244, filed on Oct. 12, 1995, now abandoned, which is a continuation-in-part of application No. 08/251,418, filed on May 31, 1994, now abandoned.

(51) Int. Cl.[7] ..... B41J 2/01

(52) U.S. Cl. ..... 347/101; 347/101; 347/105; 347/103

(58) Field of Search ..... 347/105, 101, 347/103

(56) References Cited

U.S. PATENT DOCUMENTS

| | | | |
|---|---|---|---|
| 4,246,709 | 1/1981 | Selleslags | 40/2 R |
| 4,401,787 | 8/1983 | Chen | 524/603 |
| 4,649,064 | 3/1987 | Jones | 427/256 |
| 4,756,963 | 7/1988 | Yamamoto et al. | 428/334 |
| 4,809,451 | 3/1989 | Suzuki | 40/158.1 |
| 4,857,386 | 8/1989 | Butters et al. | 428/206 |
| 4,868,581 | 9/1989 | Mouri et al. | 346/1.1 |
| 4,877,680 | 10/1989 | Sakaki et al. | 428/332 |
| 4,902,577 | 2/1990 | Butters et al. | 428/483 |
| 4,903,039 | 2/1990 | Light | 346/1.1 |
| 4,903,040 | 2/1990 | Light | 346/1.1 |
| 4,903,041 | 2/1990 | Light | 346/1.1 |
| 4,956,223 | 9/1990 | Arai et al. | 428/212 |
| 5,011,570 * | 4/1991 | Ohbayashi | 156/310 |
| 5,101,218 | 3/1992 | Sakaki et al. | 346/1.1 |
| 5,126,193 * | 6/1992 | Light | 428/327 |
| 5,317,337 | 5/1994 | Ewaldt | 346/1.1 |
| 5,984,467 * | 11/1999 | Bodager et al. | 347/101 |

FOREIGN PATENT DOCUMENTS 250 352 12/1992 (EP) .

* cited by examiner

*Primary Examiner*—John Barlow
*Assistant Examiner*—M. Shah
(74) *Attorney, Agent, or Firm*—Harold E. Cole

(57) ABSTRACT

A recording process is provided for producing recorded images having enhanced durability. The process includes applying droplets of ink by means of an ink-jet printer or a pen plotter in an image-wise fashion onto the surface of an ink-receiving layer supported on a transparent, plastic film support to record an image thereon, contacting the surface of the ink-receiving layer containing the recorded image against an opaque or transparent substrate to form a composite of the supported ink-receiving layer and the opaque or transparent substrate so that the ink-receiving layer containing the recorded image is positioned between the substrate and the transparent, plastic film support and then applying sufficient heat and pressure to the composite thus formed to adhere or laminate the supported ink-receiving layer to the substrate so that the recorded image is protected by the transparent, plastic film against abrasion, smearing, fading and water damage.

14 Claims, No Drawings

METHOD OF PRODUCING RECORDED IMAGES HAVING ENHANCED DURABILITY ON A VARIETY OF SUBSTRATES

CROSS-REFERENCE TO RELATED APPLICATIONS

This is a continuation-in-part of application Ser. No. 08/542,244 filed Oct. 12, 1995, abandoned which is a continuation-in-part of application of Ser. No. 08/251,418, filed May 31, 1994, abandoned entitled "METHOD OF PRODUCING RECORDED IMAGES HAVING ENHANCED DURABILITY ON A VARIETY OF SUBSTRATES" by Douglas E. Bugner, et al.

FIELD OF THE INVENTION

The present invention relates to a method of protecting a print formed by recording an image on a recording medium by means of an automated printing assembly such as an ink-jet printer (involving either monochrome or multi-color recording), a pen plotter or computer-aided design/computer-aided manufacturing (CAD/CAM) equipment in which the image is recorded by means of an ink.

DESCRIPTION OF THE RELATED ART

The ink-jet recording process is a process for performing recording on a recording medium in which droplets of a recording liquid (i.e., an ink) are ejected or propelled from a print head having one or more orifices onto the recording medium.

The recording liquid, or ink, generally comprises a recording agent such as a dye or a pigment and a solvent. The solvent typically is either water or a mixed solvent of water and other water miscible solvents such as polyhydric alcohols.

In ink-jet recording, numerous schemes are utilized to control the deposition of the ink droplets onto the image-recording medium to yield the desired image. In one process, known as continuous ink-jet recording, a continuous stream of droplets is charged and deflected in an image-wise manner onto the surface of the image-recording medium, while unimaged droplets are caught and returned to an ink sump. In another process, known as drop-on-demand ink-jet recording, individual ink droplets are projected as needed onto the image-recording medium to form the desired image. Common methods of controlling the projection of ink droplets in drop-on-demand printing include piezoelectric transducers and thermal bubble formation. Ink-jet recording is rapidly gaining acceptance by the public as a recording process because it generates little noise and permits economical and multi-color printing.

Pen plotter assemblies also are used quite extensively for printing valuable information with ink on a recording medium and are particularly used in the generation of computer aided graphics.

The recording media used in such recording processes typically comprise an ink-receiving layer provided on a support. The recording media include those intended for reflection viewing, which usually have an opaque support, and those intended for viewing by transmitted light, which usually have a transparent or translucent support.

A wide variety of different types of ink-receiving layers have been proposed heretofore. For example, U.S. Pat. Nos. 4,868,581 and 4,956,223 describe ink-receiving layers consisting of albumin, gelatin, caesin, starch, cationic starch, gum arabic, sodium alginate, poly(vinyl alcohol), poly (amide), poly(acrylamide), poly(vinylpyrrolidone), a quaternized poly(vinylpyrrolidone), poly(ethyleneimine), poly (vinylpyridinium halide), melamine resins, poly(urethanes), polyesters, carboxymethyl cellulose, a SBR latex, an NBR latex, poly(vinyl formal), poly(vinyl methacrylate), poly (vinyl butyral), poly(acrylonitrile), poly(vinyl chloride), poly(vinyl acetate), a phenolic resin, an alkyd resin, poly (methyl methacrylate) and the like.

In general, when such media are imaged with inks, good quality text and graphic images can be generated. However, the recorded images are not always satisfactory in terms of durability. That is, it is also desirable that the recorded images be abrasion-resistant so that they are not easily rubbed off, smear resistant, so that they can be subjected to normal handling without risk of smearing, lightfast so that they can be displayed for long periods of time without noticeable fading or shifting of colors, and waterfast, so that they are not harmed by contact with water or other liquids which might come into contact with the recording media as a result of spills or other accidental exposure to liquids. The recorded image and the ink-receiving layer in general also should be non-blocking to facilitate packaging and handling.

One method of enhancing the durability of such recorded images is disclosed in U.S. Pat. No. 4,809,451 to Suzuki where there is provided a print holder for preserving a print in which the print is sandwiched between upper and lower adhesive-bearing plates. The upper plate has an opening through which the print can be observed and in which a transparent film can be laid over the print either below or above the upper plate. This method of protecting the print, however, is unduly cumbersome and expensive.

Another method of enhancing the durability of such recorded images is proposed in U.S. Pat. No. 4,756,963 to Yamamoto et al where there is disclosed a method for protecting a print having an image formed from a dye which employs a protective member which comprises a substrate and a transfer layer provided releasably on the substrate. The method comprises the steps of laminating and contact-bonding the protective member on a surface of a side of the image of the print and a step of releasing the substrate from the laminated image leaving the transfer layer to protect the print. This method of protecting the print also is cumbersome and expensive since a protective member must first be fabricated, the transfer layer of the protective member bonded to the print and then the substrate (which is non-reusable) be stripped away from the transfer layer.

Thus, it can be seen that a need still exists in the art for providing a simple, inexpensive and readily implementable means for providing a recorded image having enhanced abrasion resistance, enhanced smear resistance, enhanced light-fastness and enhanced waterfastness. It is towards fulfilling this need that the present invention is directed.

SUMMARY OF THE INVENTION

In accordance with the present invention, it has now been found that certain of the resins which previously were used in the art to form ink-receiving layers for ink-recording media used in ink-jet and pen plotter recording processes for absorbing and fixing the recording liquids (i.e., the inks) deposited thereon, also bond or adhere to a variety of different substrates such as plain paper, photographic paper, cloth, glass, plastic film and the like when such ink-receiving layers are placed into contact with the substrate and the composite thereby formed by the supported ink-receiving layer and the substrate is exposed to heat and pressure sufficient to adhere or bond the ink-receiving layer to the substrate. Specifically we have found that certain of the previously used naturally occurring water-soluble hydrophilic resins and certain of the previously used synthetic hydrophilic and hydrophobic resins are capable of bonding an ink-receiving layer comprising or containing such a resin to a suitable substrate where the ink-receiving layer is contacted therewith and heat and pressure are subsequently applied to the composite formed by the substrate and the supported ink-receiving layer. As a result, the ink-receiving layer containing the recorded image is adhered or laminated to the substrate with the recorded image being positioned or sandwiched between the transparent, plastic film support and the substrate so that the transparent, plastic film support now serves to protect the recorded image from abrasion, smearing, fading and damage by water. In most applications, therefore, it will be appreciated that the image printed on the surface of the ink-receiving layer will be printed as its mirror image (i.e., side reversed) so that after the ink-receiving layer is laminated to the substrate, the composite substrate and recording medium will be "flipped over" so that the recorded image is now covered by and protected by the transparent, plastic film and will be right-reading against the substrate. In this manner, the print is easily and inexpensively preserved with good durability without resorting to mounting the print in a complicated print holder such as the one disclosed in the aforementioned patent to Suzuki, U.S. Pat. No. 4,809,451 or without having to provide a protective layer as in Yamamoto et al which must be releasably transferred from a separate substrate. It is to be understood, however, that not all images printed on the surface of the ink-receiving layer must be printed as their mirror image such as in the situation, for example, where the substrate itself is transparent.

To summarize, in our ink-recording process, the ink-receiving layer itself is imaged with ink and the imaged layer containing the recorded image is adhered to a suitable substrate by means of self-adhesive polymers or resins which make-up or form the ink-receiving layer. That is, the resins or polymers which make-up the ink-receiving layers used in the practice of the process of the present invention function not only to form the recording layers on which images formed from ink are recorded, but, in addition, they also function to adhere or bond the ink-receiving layers containing the recorded image to the substrate. This is possible because the polymers or resins which make-up the ink-receiving layers of the ink-recording media used in the practice of the present invention generally are non-tacky and non-adhesive under ambient conditions, but when subjected to heat they become quite tacky and adhesive. That is to say, these resins or polymers are advantageously heat activatable and become self-adhesive or self-adherent at elevated temperatures. In essence, these materials function as hot melt adhesives when subjected to sufficient heat.

Thus, there is now provided an ink-recording process which comprises the steps of:

(1) applying droplets of ink in an image-wise fashion onto the surface of an ink-receiving layer of an ink-recording medium to record an image thereon wherein the ink-recording medium comprises an ink-receiving layer provided on a transparent, plastic film support, (2) placing the surface of the ink-receiving layer containing the recorded image in contact with an opaque or transparent substrate to form a composite of the ink-recording medium and the substrate, and (3) applying temperature and pressure to the composite thus formed sufficient to adhere or bond the ink-receiving layer of the ink-recording medium to the substrate wherein the ink-receiving layer comprises at least one hydrophilic or hydrophobic resin capable of adhering or bonding the ink-receiving layer to the substrate upon the application of heat and pressure to the composite.

DESCRIPTION OF THE PREFERRED EMBODIMENTS

The recording medium used in the ink-recording process of the present invention is characterized primarily by its ink-receiving layer which comprises any suitable hydrophilic or hydrophobic ink-receptive resin or polymer or a blend of such resins or polymers, which can be coated onto a transparent plastic film support material to yield an absorbent layer capable of being imaged by an ink-jet printing device or pen plotter device or the like and which is capable of adhering or bonding the ink-receiving layer to a suitable substrate when the surface of the ink-receiving layer containing the recorded image is placed in contact with the substrate after an image has been recorded on the surface of the ink-receiving layer and heat and pressure is applied to the composite formed by the ink-recording medium and the substrate which is sufficient to adhere or bond the ink-receiving layer to the substrate.

The term "hydrophilic", as used herein, is used to describe a material that is generally receptive to water, either in the sense that its surface is wettable by water or an aqueous fluid, i.e., a fluid which contains substantial amounts of water, or in the sense that the bulk of the material is able to absorb significant quantities of water or an aqueous fluid. The term "hydrophobic," as used herein, is used to describe a material that is substantially insoluble and non-swellable in water or an aqueous fluid. More specifically, materials that exhibit surface wettability by water or an aqueous fluid are said to have hydrophilic surfaces, while materials that have surfaces that are not wettable by water or an aqueous fluid are said to have hydrophobic surfaces.

The recording medium generally comprises a transparent, plastic film support as a supporting member and a recording face provided on a surface of the support, namely the ink-receiving layer.

The ink-receiving layer comprises or contains at least one hydrophilic or hydrophobic ink-receptive resin or polymer which can be coated onto the support material to yield an absorbent layer capable of being imaged by an ink-jet printing or pen plotter device and which is capable of adhering or laminating the ink-receiving layer to a paper, cloth or glass substrate placed on the ink-receiving layer after an image has been recorded on the surface of the ink-receiving layer upon the application of heat and pressure to the composite formed by the ink-recording medium and the substrate.

The hydrophilic or hydrophobic polymer or resin comprises the major component of the ink-receiving layer. Typically, the resin or polymer comprises at least 4.0 percent by weight of the ink-receiving layer to insure that an adequate amount of the resin is present in the ink-receiving layer to adhere the ink-receiving layer to the substrate to which it is applied. As mentioned previously, such polymers or resins are generally non-tacky and non-adhesive under ambient conditions, but when subjected to heat they become quite tacky and adhesive. That is to say these resins or polymers are advantageously heat activatable and become self-adhesive or self-adherent at elevated temperatures. In essence, these materials function as hot melt adhesives when subjected to sufficient heat. If desired, the entire ink-receiving layer may be comprised of such a resin or polymer or mixtures of such resins or polymers.

Examples of suitable naturally occurring hydrophilic resins or polymers which can be used to form the ink-receiving layers of the ink-recording media used in the present invention which have a high degree of ink absorbency include albumin, gelatin, casein, starch, cationic starch, gum arabic, sodium alginate. Examples of synthetic hydrophilic resins or polymers which can be used to form the ink-receiving layers of the ink-recording media used in the present invention include poly(amide), poly(acrylamide), poly (ethyleneimine), poly(vinylpyridinium halide), melamine resins, poly(urethanes) and polyesters. In addition to the above-described thermoplastic resins, it is possible to include hydrophobic resins such as styrene-butadiene rubbers, acrylonitrile-butadiene rubbers, poly(vinyl formal), poly(methyl methacrylate), poly(vinyl butyral), poly (acrylonitrile), poly(vinyl chloride), poly(vinyl acetate), poly(olefins) and the like. Other hydrophilic and hydrophobic resins or polymers additional to those described above which can be used in the practice of the present invention can easily and readily be determined by those skilled in the art.

In a particularly preferred embodiment, a polymer or resin having a high degree of ink-absorbency is used for forming the ink-receiving layer and since an ink-jet recording method generally employs an aqueous ink, as the polymer or resin used for forming the ink-receiving layer, it is preferable to use a polymer having good ink absorbency with respect to an aqueous ink, for example, one of the water-soluble or hydrophilic polymers in the above-described polymers.

A particularly suitable ink-receiving layer for use in the recording media used in the present invention is a layer which is coated onto the support as an aqueous dispersion of particles of a polyester ionomer, namely, a poly [oxydiethylene isophthalate-co-5-sodiosulfo-benzenedicarboxylate] dispersed in a vinyl pyrrolidone polymer as disclosed in U.S. Pat. No. 4,903,040. Within this group of polyester ionomers poly[2,2"-oxydiethylene isophthalate-co-5-sodiosulfo-1,3-benzenedicarboxylate 89/11] is particularly useful.

Another particularly suitable ink-receiving layer for use in the recording media used in the present invention is a layer which is coated onto the support as an aqueous dispersion of particles of a polyester ionomer, namely a poly (cyclohexylenedimethylene-co-oxydiethylene isophthalate-co-sodiosulfobenzenedicarboxylate), dispersed in a vinyl pyrrolidone polymer as disclosed in U.S. Pat. No. 4,903,039. Within the group of polyester ionomers, polyester poly (cyclohexylenedimethylene-co-2,2'-oxydiethylene (46/54) isopthalate-co-sodiosulfobenzenedicarboxylate) (82/18)] is particularly useful.

Still another particularly suitable ink-receiving layer for use in the recording media used in the present invention is a layer which is coated onto the support as an aqueous dispersion of particles of a polyester ionomer, namely a poly[cyclohexylenedimethylene-co-oxydiethylene isophthalate-co-5-sodiosulfobenzenedicarboxylate dispersed in a vinyl pyrrolidone polymer as disclosed in U.S. Pat. No. 4,903,041. Within this group of polyester ionomers poly[cyclohexylenedimethylene-co-oxydiethylene (22/78) isophthalate-co-5-sodiosulfobenzenedicarboxylate (89/11)] is particularly useful.

The particles of polyester generally have a diameter of up to about 1 micrometer, often about 0.001 to 0.1 and typically 0.01 to 0.08 micrometer. The size of the polyester particles in the ink-receiving layer is compatible with the transparency requirements of the ink-receiving layer. The ratio, by weight of polyester to vinyl pyrrolidone polymer in the ink-receiving layer typically is at least 1:1 and generally is in the range of about 1:1 to 6:1.

The ink-receiving layers used in the recording media used in the present invention also can incorporate various known additives, including matting agents such as titanium dioxide, zinc oxide, silica and polymeric beads such as crosslinked poly(methyl methacrylate) or polystyrene beads for the purposes of contributing to the non-blocking characteristics of the recording media used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV absorbing agents; mildew-proofing agents; antistatic agents, and the like. Such additives can be selected from known compounds or materials in accordance with the objects to be achieved. It should be noted however that because the support is transparent, the type and amount of additives chosen must be such that the ink-receiving layer itself remains light transmissive or transparent, i.e. substantially non-light-scattering. In this case, therefore, care must be exercised in the selection and amounts of additives which are included in the ink-receiving layers so that the ink-receiving layers remain clear and transparent and are not rendered cloudy or hazy.

Particularly preferred ink-receiving layers for use in the recording media used in the present invention are layers which are coated onto a support as an aqueous dispersion of 45.0 to 75.0 weight percent of a water-dispersible polyester ionomer of the type disclosed and described in the above mentioned U.S. Pat. Nos. 4,903,039, 4,903,040 and 4,903,041, 25.0 to 50.0 weight percent of poly(vinyl pyrrolidone), 0 to 5.0 weight percent of a polymer (homopolymer or copolymer) of an alkylene oxide containing from 2 to 6 carbon atoms, as a surface active agent, 0 to 5.0 weight percent of poly(vinyl alcohol), 0.1 to 3.0 weight percent poly(methyl methacrylate-co-divinylbenzene) particles having an average particle size of 3 to 30 micrometers to enhance the smoothness of the ink-receiving layer and 0.1 to 1.0 weight percent of propylene glycol butyl ether as a surfactant to provide an ink-receiving layer having a uniform thickness.

The polymerized alkylene oxide components constitute nonionic surface active polymers including homopolymers and copolymers of an alkylene oxide in which alkylene refers to carbon linkages such as ethylene, propylene, butylene and the like and are characterized by molecular weights of from about 100,000 to 5,000,000 weight average molecular weight. Poly(ethylene oxide) is a particularly preferred poly(alkylene oxide).

The ink-receiving layer is conveniently applied to the support material by deposition from a solution or dispersion of the hydrophilic resin or polymer and other additives as mentioned above, if desired, in a volatile medium, such as an aqueous or organic solvent medium in accordance with known coating procedures such as immersion or dip coating, roll coating, reverse roll coating, air knife coating, doctor blade coating, bead coating and curtain coating, followed by drying as rapidly as possible with a dryer such as a hot-air dryer or a hot-air oven, a hot drum or the like.

The ink-receiving layer may have a dry thickness sufficient for absorbing and capturing the recording liquid or ink, which may range, though variable depending on the amount of recording liquid, from 1 to 30 micrometers, preferably from 5 to 20 micrometers.

The support materials utilized in the recording media used in the present invention are transparent materials. Most typically, plastic film is used as the transparent support. For the preparation of the recording media used in the process of the present invention, the support can be composed of cellulose esters, such as cellulose triacetate, cellulose acetate propionate or cellulose acetate butyrate, polyesters such as poly(ethylene terephthalate), polyamides, polyimides, polycarbonates, polyolefins, poly(vinyl acetals), polyethers, poly(vinyl chloride) resins, polysulfonamides, polystyrene and the like. Polyester supports, and especially poly (ethylene terephthalate), are preferred because of their excellent dimensional stability characteristics. The support must be transparent and may contain known additives including UV light absorbers to filter out ultraviolet light so as to enhance the lightfastness of the recorded image. The UV absorber should be capable of absorbing light mainly in the 250 to 400 nanometer region from the light penetrating the transparent support. The light in this wavelength range is mainly responsible for the decomposition and deterioration of the dyes used as recording agents in recording liquids, thereby discoloring, fading or bleaching the image. The following compounds can be cited as suitable ultraviolet absorbers: 2,2'-dihydroxy-4-dimethoxybenzophenone (CYASORB UV-24 available from ACC); benzophenone compounds such as 2,2'-dihydroxy-4,4'-dimethoxybenzophenone (UVINUL D-49 available from BASF); 2-(2'-hydroxy-5'-methylphenyl)benzotriazole, (TINUVIN P available from Ciba Geigy); 2-(2'-hydroxy-5'-tert-butylphenyl)benzotriazole (TINUVIN PS available from Ciba Geigy); 2-(2'-hydroxy-3',5'-di-tert-butylphenyl) benzotriazole (TINUVIN 320 available from Ciba Geigy); 2-(2'-hydroxy-3'-tert-butyl-5'-methylphenyl)-5-chlorobenzotriazole (TINUVIN 326 available from Ciba Geigy); phenyl salicylate (SEESORB 201 available from Nisseki Calcium); p-tert-butylphenyl salicylate (SUMISORB 90 available from Sumitomo Chemical) and salicylic acid compounds such as p-octylphenyl salicylate (OPS available from Eastman Chemical).

Examples of other additives which may be included in the support are plasticizers, tackifiers, antioxidants, antistatic agents, and the like.

In addition, the support must be self-supporting. By "self-supporting" is meant a support material such as a sheet or film that is capable of an independent existence in the absence of a supporting substrate. The support is suitably of a thickness of from about 6 micrometers to about 250 micrometers, preferably from about 25 micrometers to 125 micrometers. If desired, in order to promote adhesion of the ink-receiving layer to the polymeric support, the surface of the support may first be treated with a chemical priming medium as is generally known in the art. Examples of such conventional priming or adhesion promoting agents for forming a priming layer on the surface of the support include halogenated phenols or partially hydrolyzed vinyl chloride-vinyl acetate copolymers. Such a copolymer conveniently contains from 60 to 98 percent of vinyl chloride and from 0.5 to 3 percent of hydroxyl units, by weight, of the copolymer. The molecular weight (number average molecular weight) of the copolymer is in a range of from 10,000 to 30,000 and preferably from 16,500 to 25,000.

The priming agent suitably is applied at a concentration level which will yield a priming layer having a relatively thin dry coat thickness, for example, generally less than 2, and preferably less than 1, micrometer. Alternatively, the support surface may be corona-discharged-treated prior to applying the ink-receiving layer to the support surface in order to promote adhesion of the ink-receiving layer to the support.

After the ink-receiving layer containing a recorded image is adhered to a suitable substrate in accordance with the practice of the present invention, the transparent plastic, film which formerly served as the support for the ink-receiving layer now serves as a transparent protective film to protect the recorded image against abrasion, smearing, fading and damage by water. The recording media used in the practice of the present invention are fabricated in such a manner that the transparent protective film (i.e., formerly the support) is in contact with and entirely covers the non-printed surface of the ink-receiving layer so that it conforms in size and shape to the ink-receiving layer and is in good agreement therewith so that the recorded image is protected by the transparent protective film from damage as discussed previously after the ink-receiving layer has been adhered to the substrate. The ink-receiving layer containing the recorded image is then adhered or laminated to a suitable substrate by applying heat and pressure to the composite formed by the substrate and the ink-recording medium so that the recorded image is positioned or sandwiched between the substrate and the transparent protective, plastic film using an ordinary laminating device such as a flat bed press or a roller press as will be described in greater detail below. In this manner, the recorded image or print is positioned beneath the transparent protective film and is thereby protected against abrasion, smearing, fading and damage by water. Typically, as mentioned before, the image will be printed on the surface of the ink-receiving layer as its mirror image and after the ink-receiving layer is adhered to the substrate, the composite formed by the substrate and the ink-recording medium will be "flipped over" so that the image is right reading against the substrate and is protected by what formerly served as the transparent, plastic support for the ink-receiving layer.

Adhesion of the ink-receiving layer to the substrate is achieved through a lamination step or process in which sufficient heat and pressure are applied to the composite formed by the substrate and the image-recording medium to bond or adhere the ink-receiving layer to the substrate. Conditions such as time, temperature and pressure will vary depending upon the particular materials which are selected for use as the substrate and the ink-receiving layer. Such conditions can easily and readily be determined by one skilled in the art without any undue experimentation. Typically, if a roller press is utilized the composite can be passed through a pair of nip rollers under a pressure of from about 2.0 to 20 psi preferably 5.0 to 15 psi, at a speed of 24 inches per minute when the roller adjacent the substrate is heated to a temperature of 90° C. and the roller adjacent the transparent protective film is heated to 100° C. Any suitable commercially available laminating device may be used. Such laminating devices may be in the form of a flat-bed press, for example, or a roller press as mentioned previously. In a flat-bed press, the composite is heated all at once under pressure for a time sufficient to achieve adequate adhesion. In a roller press, the composite is fed between a pair of heated rollers under pressure. The movement and friction of the rollers causes the composite to incrementally pass through the nip formed by the two rollers. The speed of the rollers is adjusted to provide a sufficient time in the nip to achieve adequate adhesion.

The substrates to which the ink-receiving layers used in the practice of the present invention can be adhered to can be virtually any substrate to which the polymers and resins used to form the ink receiving layers of the ink-recording media used in the practice of the present process are capable of adhering to upon the application of heat and pressure to the substrate and the ink-recording media which is sufficient to adhere the ink-receiving layer to the substrate. Such substrates may be, for example, planar or curved, and may comprise such materials as plain paper, photographic paper, cloth, glass, plastic film and the like. In a particularly preferred embodiment of the present invention, the ink-recording process of the present invention can be used to label or identify compact discs (i.e. CDs) by first recording the information desired to identify the disc on an ink-receiving layer of the type disclosed and described herein and then laminating the ink-receiving layer containing the recorded information to a surface of the compact disc so that the information is now attached to the disc and is protected by the transparent plastic film "support" of the ink-receiving layer from abrasion, smearing, fading, water damage and the like. Such a method for labeling compact discs in this manner is very valuable since it does away with previously used and more expensive labeling techniques such as transfer lithography and silk-screening.

The inks used to image the recording media used in the present invention are well-known inks. The ink compositions used in ink-jet printing typically are liquid compositions comprising a solvent or carrier liquid, dyes or pigments, humectants, organic solvents, detergents, thickeners, preservatives, and the like. The solvent or carrier liquid can be comprised solely of water or can be predominantly water mixed with other water miscible solvents such as polyhydric alcohols, although inks in which organic materials such as polyhydric alcohols are the predominant carrier or solvent liquid also may be used. Particularly useful are mixed solvents of water and polyhydric alcohols. The dyes used in such compositions are typically water-soluble direct or acid type dyes. Such liquid ink compositions have been described extensively in the prior art including for example, U.S. Pat. Nos. 4,381,946; 4,239,543 and 4,781,758.

The invention is further illustrated by reference to the following examples.

EXAMPLE 1

An ink-receiving layer coating composition was coated on a transparent support consisting of a 4.0 mil thick film of poly(ethylene terephthalate) at a dry laydown coverage of 1.5 g/ft$^2$ to form a recording medium used in the invention. The support was corona-discharge-treated just prior to the application of the coating composition.

The ink-receiving layer was coated from a composition comprising 6.59 weight percent poly[1,4-cyclohexylenedimethylene-co-2,2'-oxydiethylene (22/78) isophthalate-co-5-sodiosulfo-1,3-benzenedicarboxylate (82/18)] (obtained from Eastman Chemical Company as AQ38S), 2.83 weight percent poly(vinyl pyrrolidone (supplied by BASF Corporation under the tradename Kollidon 90), 0.2 weight percent poly(ethylene oxide obtained from Aldrich Chemical Company), 0.2 weight percent poly (vinyl alcohol) (sold by Air Products and Chemicals under the tradename AIRVOL 165), 0.07 weight percent poly (methyl methacrylate-co-divinylbenzene) particles having an average particle size of 5 micrometers, 0.11 weight percent propylene glycol butyl ether (obtained from Union Carbide Corporation under the tradename Propasol-B), and 90.0 weight percent distilled water. The coating was dried to remove the water thereby forming a dry ink receiving layer as defined previously herein.

The ink-receiving layer was imaged with a Hewlett Packard Desk Writer 550C 4-color ink-jet printer. The image was electronically "flipped" such that a mirror image of the intended image was applied to the ink receiving layer. The ink-receiving layer of the ink-recording medium containing the recorded image was then placed into contact with an opaque paper substrate sold under the tradename Wassau Offset Opaque conforming in size and shape to the recorded image-bearing surface of the ink-receiving layer such that the ink-receiving layer was positioned or sandwiched between the opaque paper substrate and the transparent support. The composite ink-recording medium and substrate thus formed was then passed through a pair of heated rollers at a rate of 24 inches (60.96 cm) per minute. The top roller which was 3 inches (7.62 cm) in diameter and was adjacent to the transparent support was heated to 100° C. and the bottom roller which was 3 inches (7.62 cm) in diameter and which was adjacent to the opaque substrate was heated to 90° C. The laminated composite exhibited excellent adhesion. Attempts to manually separate the paper substrate from the ink-receiving layer were unsuccessful.

COMPARATIVE EXAMPLE 2

A commercially available ink-recording media, namely an ICI 4GP735T Business Graphics Ink Jet Film, obtained from the Imagedata Division of Imperial Chemical Industries, Brantham Manningtree, England having an ink-receiving layer not containing any of the self-laminating polymers or resins of the type or kind disclosed and described herein for use in the practice of the present invention was tested for adhesion of its ink-receiving layer to the same substrate described in Example 1 using the same conditions as set forth in Example 1 with the result that the film readily separated from the paper after lamination. These results demonstrate the self-adhesive properties of the polymers and resins used to form the ink-receiving layers of the ink-recording media used in the practice of the present process.

As mentioned previously, although the present invention is directed primarily towards a process for producing recorded images having enhanced durability in which the recorded images are produced by means of an ink-jet printer in which droplets of ink typically are ejected through one or more orifices of a print head onto an ink-recording media of the type described herein, images which have been recorded on the surface of an ink-receiving layer of an ink-recording media of the type described herein by means of a pen plotter which operates by writing directly on the surface of the ink-receiving layer using a pen typically consisting of a bundle of capillary tubes in contact with an ink reservoir having enhanced durability also can be produced in the same manner as those images produced by an ink-jet printer. That is, after an image has been created or recorded on the ink-receiving layer of an ink-recording medium of the type described herein by means of a pen plotter, the ink-receiving layer of the ink-recording medium can be contacted against a substrate of choice and the composite thus formed consisting of the substrate and the recording medium can be subjected to heat and pressure sufficient to laminate the ink-receiving layer of the recording medium to the substrate.

EXAMPLE 2

A prototype CD label was generated on a Macintosh IIci™ computer using a combination of MacDraw™ and adobe Photoshop™ software applications. First a CD template was generated using MacDraw™. This template was stored in a PICT format. In adobe Photoshop™, a PhotoCD™ 4Base image (hereinafter referred to as the "target image") was opened in one window, and the CD template was opened in a second window. Desired changes were made to the target image. For example, the color balance was adjusted, text was added, and finally the image was flipped horizontally to produce the mirror image. The CD template was resized to match the desired region of the target image. The CD template was then copied and "pasted" onto the target image. The template was repositioned as desired. The new image (hereinafter referred to as the "label") was saved in a new file.

The label was printed on a transparent receiver of the type described in Example 1 using a Hewlett-Packard DeskWriter™ 550C color ink jet printer. The printed label was processed under the following conditions:

Page Setup Menu:
- Media: Transparency
- Size: 120 mm
- Options: Precision bitmaps, HP font substitution
- Colors: Scatter (intensity=3), complex color printing, minimize black and color mixing Print Menu:
- Quality: Best The label was allowed to dry overnight, and was the laminated to the back side of a CD as follows. The back side of the CD was prepared by screen-printing a white UV-curable ink onto a protective layer previously coated on the back side of the CD. Following screen printing, the back side of the CD was wiped to remove materials which could degrade the adhesion of the transparent receiver to the back side of the CD.

The label was trimmed from the transparent receiver to include only the annular region. The label was then placed on the back side of a CD so as not to extend past the edge of the CD. The package was laminated by passing it through a pair of heated rollers at a rate of 33 inches per minute and operating at 100° C.

The invention has been described with reference to certain preferred embodiments, but it will be understood that variations and modifications can be made within the spirit and scope of the invention.

What is claimed is:

1. An ink recording process which comprises the steps of:

(1) applying droplets of ink in an image-wise fashion onto a surface of an ink-receiving layer of an ink-recording medium to record an image thereon, said ink-recording medium comprising said ink-receiving layer provided on a transparent, plastic film support;

(2) placing the surface of said ink-receiving layer containing said recorded image in contact with a substrate comprising paper, cloth or glass to form a composite of said ink-recording medium and said substrate, and (3) applying temperature and pressure to the composite thus formed sufficient to bond said ink-receiving layer of said ink-recording medium to said substrate, said ink-receiving layer comprising at least one hydrophilic resin that bonds said ink-receiving layer to said substrate upon the application of heat and pressure to said composite.

2. A recording process of claim 1, wherein said hydrophilic resin comprises a polyester.

3. A recording process of claim 1, wherein said polyester is a poly(oxydiethylene isophthalate-co-5-sodiosulfobenzenedicarboxylate).

4. A recording process of claim 2, wherein said polyester is a poly(cyclohexylenedimethylene-co-oxydiethylene isopthalate-co-sodiosulfobenzene-dicarboxylate).

5. A recording process of claim 3, wherein said polyester is a poly(cyclohexylenedimethylene-co-oxydiethylene isophthalate-co-5-sodiosulfobenzenedicarboxylate).

6. A recording process of claim 5, wherein the polyester is poly[1,4-cyclohexylenedimethylene-co-2,2'-oxydiethylene (22/78) isophthalate-co-5-sodiosulfo-1,3-benzenedicarboxylate (89/11)].

7. A recording process of claim 3, wherein the receiving layer comprises particles of a poly[2,2'-oxydiethylene isophthalate-co-5-sodiosulfo-1,3-benzenedicarboxylate (89/11)) dispersed in a vinylpyrrolidone polymer.

8. A recording process of claim 1, wherein the receiving layer comprises particles of a poly[1,4-cyclohexylenedimethylene-co-2,2'-oxydiethylene (22/78) isophthalate-co-5-sodiosulfo-1,3-benzenedicarboxylate (89/11)] dispersed in a vinylpyrrolidone polymer.

9. A recording process of claim 1, wherein the ink-receiving layer comprises 45.0 to 75.0 weight percent of poly[1,4-cyclohexylenedimethylene-co-2,2'-oxydiethylene (22/78) isophthalate-co-5-sodiosulfo-1,3-benzenedicarboxylate (89/11)], 25.0 to 50.0 weight percent of poly(vinylpyrrolidone), 0 to 5.0 weight percent of a a polymer of an alkylene oxide containing from 2 to 6 carbon atoms, 0–5.0 weight percent of poly(vinyl alcohol), 0.1 to 3.0 weight percent poly((methyl methacrylate-co-divinylbenzene), and 0.1 to 1.0 weight percent propylene glycol butyl ether.

10. A recording process of claim 1, wherein the support is a polyester film.

11. A recording process of claim 10, wherein the polyester is poly(ethylene terephthalate).

12. A recording process of claim 1, wherein the ink-receiving layer has a dry thickness from 1 to 30 micrometers.

13. A recording process of claim 1, wherein the support has a dry thickness from 6 to 250 micrometers.

14. A recording process of claim 1, wherein the substrate is a surface of a compact disc.

* * * * *